US006283128B1

(12) United States Patent
Saxton

(10) Patent No.: US 6,283,128 B1
(45) Date of Patent: Sep. 4, 2001

(54) HAIR ROLLER

(76) Inventor: Roxanne Saxton, 2641 Onzaga St., New Orleans, LA (US) 70119

( * ) Notice: Subject to any disclaimer, the term of this patent is extended or adjusted under 35 U.S.C. 154(b) by 0 days.

(21) Appl. No.: 09/631,739

(22) Filed: Aug. 4, 2000

(51) Int. Cl.[7] ..... A45D 2/18
(52) U.S. Cl. ..... 132/246
(58) Field of Search ..... 132/223, 226, 132/245, 246, 247, 248, 250, 253, 273

(56) References Cited

U.S. PATENT DOCUMENTS

| | | | | |
|---|---|---|---|---|
| 1,163,343 | * | 12/1915 | Illoway | 132/246 |
| 1,495,054 | * | 5/1924 | West | 132/250 |
| 1,552,618 | * | 9/1925 | Klemm, Jr. | 132/246 |
| 2,061,356 | | 11/1936 | Gosewisch . | |
| 2,525,981 | * | 10/1950 | Webster | 132/246 |
| 2,563,421 | | 8/1951 | Roth . | |
| 2,693,809 | | 11/1954 | Spencer . | |
| 3,316,920 | | 5/1967 | Cruise . | |
| 4,310,008 | | 1/1982 | Lalli . | |
| 5,694,955 | | 12/1997 | Grooms . | |
| 5,727,576 | | 3/1998 | Eren . | |
| 5,771,907 | | 6/1998 | Dickson . | |

FOREIGN PATENT DOCUMENTS

| | | | | |
|---|---|---|---|---|
| 597788 | * | 4/1978 | (CH) | 132/246 |
| 466590 | * | 8/1935 | (GB) | 132/246 |

* cited by examiner

*Primary Examiner*—Jeffrey A. Smith
*Assistant Examiner*—Eduardo C. Robert
(74) *Attorney, Agent, or Firm*—Thomas S. Keaty; Keaty Professional Law Corporation

(57) ABSTRACT

A hair roller has a multi-layer construction, with all layers being soft and comfortable to allow the user to wear the hair rollers during sleep. The hair roller has an inner cellular foam layer, a compressible intermediate layer made of d-suede or velvet and an outer layer made of satin or silk. The roller may have a solid core. Pair of chenille cord securing members extends from opposite ends of the cylindrical roller body to allow securing of the hair roller in place after a strand of hair has been wound on the roller body.

17 Claims, 1 Drawing Sheet

HAIR ROLLER

BACKGROUND OF THE INVENTION

This invention relates to a device for imparting curls on hair and, more particularly, to a hair curler which is comprised of several compressible layers for making the hair roller more comfortable in use.

The use of curling hair rollers has been known for many years. Hair rollers come in various shapes; they are manufactured from a variety of materials, some relatively porous, like sponge, some more solid, like plastic or metal. The rollers are secured using a variety of devices, such as clamps, rubber bands, mesh caps and the like. One of the desirable characteristics of the hair roller is elimination of a "frizzy" look and the ability of the user to retain hair rollers for an extended period of time without discomfort.

Many users retain hair rollers on the hair throughout the night in an effort to impart a longer lasting wave to the hair. The traditional hair rollers made of stiff plastic are uncomfortable to sleep on and, consequently, hair rollers were developed that are made of open-pore material, such as foam placed over a solid core. However, the use of foam rollers tends to split hair ends and make the hair dry.

To solve the split-ends problem, various solutions have been offered. One of these is disclosed in U.S. Pat. No. 2,061,356 issued on Nov. 17, 1936. In that patent, a sponge rubber core is wrapped in a knitted or woven fabric. Another solution is offered by U.S. Pat. No. 2,693,809 issued on Nov. 9, 1954, wherein a flat strip of metal forming a core of the hair roller is covered by a pad of cotton, paper, or other similar soft, absorbent material. The next layer is formed by cotton gauze.

U.S. Pat. No. 5,694,955 issued on Dec. 9, 1997 offers still another solution. The '955 patent discloses the use of a soft, deformable core placed in an envelope with two protruding members. The protruding members are used for securing the roller on the user's head, while the soft deformable core can be made of foam rubber, soft plastic, sponge, and the like. Another example is shown in U.S. Pat. No. 5,771,907 issued on Jun. 30, 1998, wherein a polyurethane core is covered and sealed within a soft towel-like outer covering.

While these patents show improvement over the simple solid core or porous core rollers, they still cannot provide sufficient "padding" for a person to comfortably rest her head at night. The present invention contemplates elimination of drawbacks associated with the prior devices and provision of an improved hair roller that is soft and comfortable for retaining through the night, while protective enough to eliminate split-ends and frizzy hair.

SUMMARY OF THE INVENTION

It is, therefore, an object of the present invention to provide a hair roller that is soft and comfortable to wear at night.

It is another object of the present invention to provide a hair roller with flexible adjustable securing members for retaining the hair roller in place.

It is a further object of the present invention to provide a hair roller that reduces the likelihood of split-ends and frizzy look.

These and other objects of the invention are achieved through a provision of a hair roller that is lightweight and soft to allow a user to comfortably wear the hair roller through the night. The hair roller has a generally cylindrical body of multi-layer construction. The inner layer may be formed around a solid flexible core, the inner layer being made of an open cell material, such as cellular foam, rubber foam, sponge foam and the like. The cellular foam material is used to impart the round shape to the hair being waved. The inner layer may be cut into various-diameter sizes.

An intermediate layer encloses the inner layer, the intermediate layer being also soft, compressible porous, very flexible. The intermediate layer may be made of d-suede, velvet and other similar material. The final outer layer is soft, compressible, similar to the first two layers, and provides a very smooth outer surface. The outer layer may be made of satin or silk that has a very low friction coefficient.

A pair of chenille securing members extends from opposite ends of the roller body. The securing members are brought together and secured after a strand of hair has been wound on the roller body. The chenille securing members are also soft, easy compressible and do not interfere with the user's comfortable rest at night.

BRIEF DESCRIPTION OF THE DRAWINGS

Reference will now be made to the drawings, wherein like parts are designated by like numerals and wherein.

DETAIL DESCRIPTION OF THE PREFERRED EMBODIMENT

Figure 1:
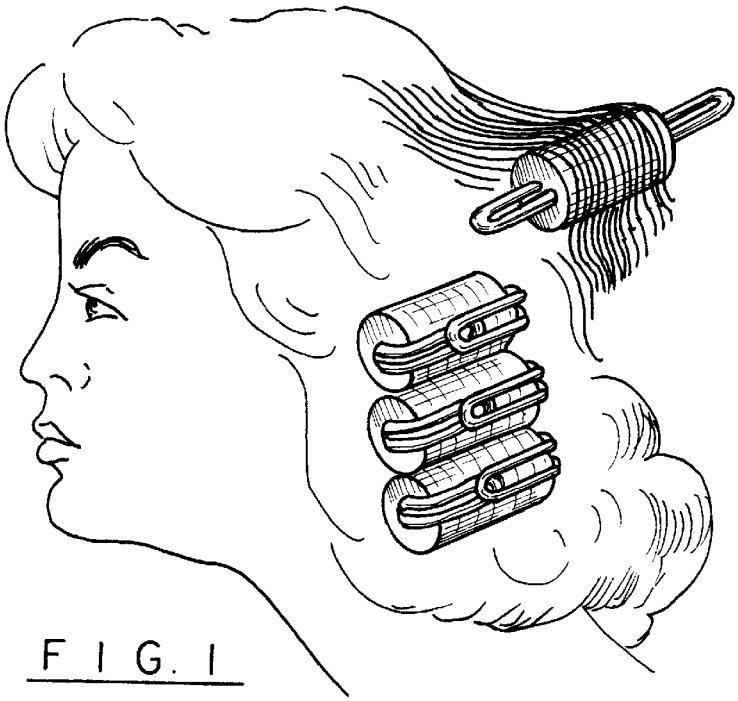
FIG. 1 is a perspective view of the hair roller in accordance with the present invention in position on a human head.

Referring now to the drawings in more detail, numeral 10 designates a hair roller in accordance with the present invention. As can be seen in the drawings, the hair roller 10 comprises a hair roller body 12 and a pair outwardly extending securing members 14 and 16. The body 12 comprises several layers of compressible, porous materials, all of which are designed to provide a soft, resilient compressible structure that avoids or altogether eliminates formation of split-ends on user's hair.

The body 12 has a solid core 20 made of plastic or other strong resilient material. The core 20 is surrounded by an inner layer 22 made of lightweight soft deformable compressible cellular material, such as foam rubber, sponge rubber and the like.

The inner layer 20 has a generally cylindrical shape to provide the rounded form to the hair rolled on the body 12. The diameter of the layer 22 can differ depending on the size of wave desired by the user; it can differ from about 0.5 inches to about 2 inches. Of course, any other size may be used; the above exemplary sizes should not be interpreted in a limiting sense.

A second intermediate layer 24 encloses the inner layer 22. The intermediate layer 24 is made of soft, deformable material, for example, velvet, d-suede, and the like. The layers 22 and 24 are secured together by sewing at their respective ends.

The final, outer layer 28 fully encloses the core 20 and layers 22 and 24. The outer layer 28 is made of soft deformable compressible smooth surface material, for example satin, silk or the like. These materials, having a relatively low friction coefficient, are gentle on the hair, preventing split-ends.

Figure 2:
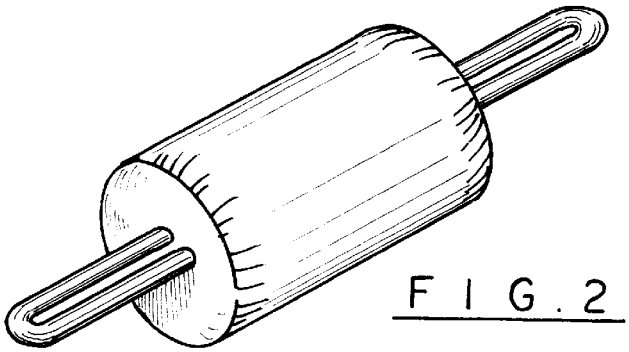
FIG. 2 is a perspective view of the hair roller of the present invention, with the securing members extended from opposite sides of the roller body.

As can be seen in FIG. 2, the hair roller body 12 is formed as a cylinder with seams 30 at opposite ends thereof. Generally circular end panels 32 and 34 are secured on each opposing end of the body 12. The end panels 32,34 can be made of a material similar to the outer layer 28, such as satin or silk. Of course, the body 12 may be covered with a tube-shaped outer layer 28. In that case, it is envisioned that the end panels 32, 34 would not be true circular in shape but would rather tighten around the foam layer 22 and the intermediate layer 24.

Figure 3:
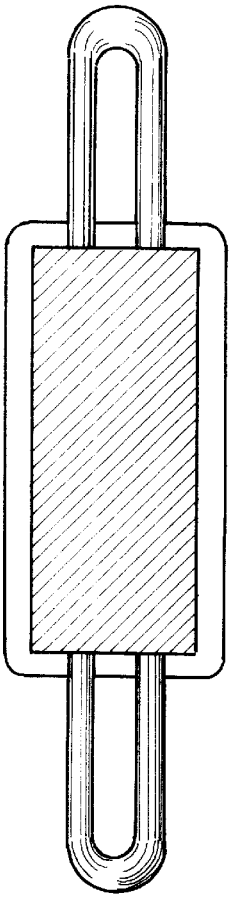
FIG. 3 is a longitudinal section of the hair roller of the present invention.
Figure 4:
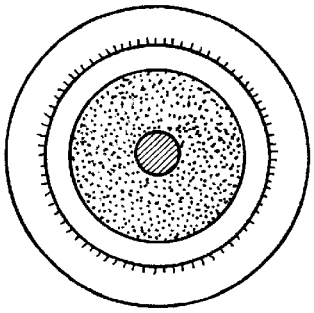
FIG. 4 is a cross-sectional view through the body of the hair roller.

The roller body 12 is provided with securing members 14 and 16 at opposite ends thereof. The securing members 14 and 16 are made from flexible bendable material, for example chenille. The chenille cord is cut to a predetermined length and folded to form a U-shaped member. The chenille stems 14 and 16 may extend through the outermost and intermediate layers 28 and 24 and only to a certain distance into the foam layer 22, as shown in FIG. 3.

Alternatively, the securing members 14 and 16 may extend through the entire body 12 as a continuous loop member with opposing ends (not shown) secured together and positioned inside the inner layer 22. In such a case, it is envisioned that the need for the solid core 20 may be replaced by the twin stems 14 and 16.

The securing members 14 and 16 extend outwardly from the body 12 through corresponding openings (not shown) provided in the inner layer 22, intermediate layer 24, and outer layer 28. If end panels 32, 34 are provided, these openings are formed in the end panels. If the outer layer has a tube-like construction, the securing member 14 and 16 simply extend through the outer layer 28 in the location of the cylindrical body ends.

In operation, the user rolls a strand of hair 40 around the body 12 and folds the securing members 14 and 16 against each other, overlapping the outermost end of the securing member 14 over the outermost end of the securing member 16. The stems 14 and 16, being flexible and deformable, may be bent at any designed angle, overlapping the body 12 as well as the hair strand 40, in the manner shown in FIG. 1.

Each of the securing members 14 and 16 is intentionally made longer than half length of the body 12 to allow such overlapping and securing of the roller and hair in place. The securing members 14 and 16 are also soft, compressible, have a deep pile which makes them also comfortable for an extended use.

At the same time, the chenille cord is easily bendable to facilitate adjustments of the securing members 14 and 16 to a desired shape and positioning on the hair. The resultant securing of the hair roller 10 is sufficient to retain the roller 10 in place even if the user twists and turns during sleep.

The diameter of the body 12 can differ to create smaller or larger curls, while the materials discussed above are to be interpreted as exemplary without limiting the invention to the particular examples given. The entire roller 10 is lightweight, soft and provides the necessary air circulation and moisture absorbency. The smooth, silky outer layer helps smooth the hair and keep it from getting frizzy, while the inner layers are soft, moisture absorbent, and deformable enough to allow comfortable sleeping with the hair rollers in place.

Many changes and modifications can be made in the design of the present invention without departing from the spirit thereof. I, therefore, pray that my rights to the present invention be limited only by the scope of the appended claims.

I claim:

1. A hair roller, comprising:

a generally cylindrical roller body having a resilient solid core, an inner porous compressible layer enclosing the core, an intermediate flexible compressible layer surrounding the inner layer and an outer flexible compressible layer with smooth outer surface having a lower coefficient of friction than outer surfaces of said inner layer and of said intermediate layer so as to prevent split ends on user's hair, said outer layer enclosing the inner layer and the intermediate layer; and a means fixedly attached to said body for securing said body on user's hair after a strand of hair has been wound on the roller body.

2. The device of claim 1, wherein said securing means comprises a pair of flexible bendable compressible securing members extending from opposite ends of said body.

3. The device of claim 2, wherein each of said securing members has a generally U-shaped configuration.

4. The device of claim 2, wherein each of said securing members is made of a chenille cord.

5. The device of claim 1, wherein said inner layer is formed from a cellular foam.

6. The device of claim 1, wherein said intermediate layer is formed from d-suede.

7. The device of claim 1, wherein said intermediate layer is formed from velvet.

8. The device of claim 1, wherein said outer layer is formed from satin.

9. The device of claim 1, wherein said outer layer is formed from silk.

10. A hair roller, comprising:

a generally cylindrical roller body having an inner porous cellular foam layer, an intermediate flexible compressible layer surrounding the inner layer and an outer satin layer enclosing the inner layer and the intermediate layer said satin layer having an outer surface that has a lower coefficient of friction than outer surfaces of said inner layer and said intermediate layer so as to prevent split ends on user's hair; and a pair of flexible compressible securing members fixedly attached to said body for securing said body on user's hair after a strand of hair has been wound on the roller body, each of said securing members being made of a chenille cord to facilitate user's comfort when using the hair roller.

11. The device of claim 10, wherein said securing members extend from opposite ends of said body and have a generally U-shaped form.

12. The device of claim 10, wherein said intermediate layer is made of d-suede.

13. The device of claim 10, wherein said intermediate layer is made of velvet.

14. The device of claim 10, wherein each of said securing members has a U-shaped configuration.

15. The device of claim 10, wherein each of said securing members has a length greater than one-half of the length of the roller body.

16. A hair roller, comprising:

a generally cylindrical roller body having a solid resilient core, an inner porous cellular foam layer, an intermediate velvet layer surrounding the inner layer and an outer satin layer enclosing the inner layer and the intermediate layer said satin layer having an outer surface that has a lower coefficient of friction than outer surfaces of said inner layer and said intermediate layer so as to prevent split ends on user's hair; and a pair of flexible compressible securing members fixedly attached to said body for securing said body on user's hair after a strand of hair has been wound on the roller body, said securing members extending outwardly from opposing ends of said cylindrical body, each of said securing members having a U-shaped configuration, each of said securing members being made of a chenille cord to facilitate user's comfort when using the hair roller.

17. The device of claim 16, wherein said roller body has a pair of end panels covering the area of attachment of said securing members to the roller body.

* * * * *